US005666710A

United States Patent [19]

Weber et al.

[11] Patent Number: 5,666,710

[45] Date of Patent: Sep. 16, 1997

[54] BLIND RIVET SETTING SYSTEM AND METHOD FOR SETTING A BLIND RIVET THEN VERIFYING THE CORRECTNESS OF THE SET

[75] Inventors: Richard G. Weber, Ridgefield; Jeffrey T. Blake, Milford; William E. O'Connor, Waterton; Charles F. Smart, Brookfield, all of Conn.

[73] Assignee: Emhart Inc., Newark, Del.

[21] Appl. No.: 425,079

[22] Filed: Apr. 20, 1995

[51] Int. Cl.[6] ..... B21J 15/28

[52] U.S. Cl. ..... 29/243.523; 72/21.1; 72/21.4; 227/2

[58] Field of Search ..... 72/20.1, 20.4, 72/21.1, 21.4, 391.4; 227/1–4; 29/243.521, 243.523, 243.524

[56] References Cited

U.S. PATENT DOCUMENTS

| | | | |
|---|---|---|---|
| 4,120,367 | 10/1978 | Wagner . | |
| 4,163,311 | 8/1979 | Sigmund . | |
| 4,811,881 | 3/1989 | Heck | 227/4 |
| 4,901,431 | 2/1990 | Gast . | |
| 5,027,631 | 7/1991 | Naito | 72/21.1 |
| 5,035,129 | 7/1991 | Denham et al. | 29/243.523 |
| 5,035,353 | 7/1991 | Smart et al. | 227/3 |
| 5,036,576 | 8/1991 | Gast | 227/2 |
| 5,098,001 | 3/1992 | Smart et al. | 227/51 |
| 5,125,151 | 6/1992 | Smart | 227/2 |
| 5,323,946 | 6/1994 | O'Connor et al. | 227/2 |

FOREIGN PATENT DOCUMENTS

| | | | |
|---|---|---|---|
| 454890 | 11/1991 | European Pat. Off. | 29/243.523 |
| 572819 | 12/1993 | European Pat. Off. . | |
| 642890 | 3/1995 | European Pat. Off. . | |
| 4217901 | 12/1993 | Germany | 29/243.523 |
| 4401134 | 7/1995 | Germany . | |

*Primary Examiner*—David Jones
*Attorney, Agent, or Firm*—E. D. Murphy

[57] ABSTRACT

A system for first setting a blind rivet and then verifying the correctness of the set comprising a rivet setting tool to set the rivet and computer logic to verify the correctness of the set. The setting tool includes a jaw assembly for holding the stem of the rivet's mandrel fitted to an axially movable pulling shaft. Both the pulling force of the setting tool and the displacement of the pulling shaft are measured and the measurements are interpreted by an integrator to determine the total energy of the setting process. The determined total energy is then compared with an ideal total energy to assess whether or not the set of the particular rivet is acceptable. Other quantitative comparisons may be made against other ideal values.

24 Claims, 3 Drawing Sheets

BLIND RIVET SETTING SYSTEM AND METHOD FOR SETTING A BLIND RIVET THEN VERIFYING THE CORRECTNESS OF THE SET

BACKGROUND OF THE INVENTION

1. Technical Field

This invention relates to the setting of blind rivets. More particularly, this invention relates to a blind rivet setting system in which a blind rivet is first set and then the correctness of the set of the rivet is verified.

2. Discussion

Rivets are widely used to firmly fasten together two or more components with little susceptibility to loosening and thus produce a tight joint at low cost.

The setting of the common rivet is accomplished when one end of the rivet is mechanically deformed to create a second head. The blind rivet is a special class of rivet that can be set without the need for mechanical deformation by a separate tool to create the second head. Special blind rivet setting tools are used for setting these types of rivets. Examples of such setting tools may be found in U.S. Pat. No. 3,713,321, issued on Jan. 30, 1973 to Gabriel for RIVET GUN, U.S. Pat. No. 3,828,603, issued on Aug. 13, 1974 to Scheffield et al. for RIVETING APPARATUS, and U.S. Pat. No. 4,263,801, issued on Apr. 28, 1981 to Gregory for HYDRAULIC RIVETER. These tools provide various approaches to setting rivets including setting by hydraulic and pneumatic power. A relatively sophisticated version of a blind rivet setting tool is disclosed in U.S. Pat. No. 4,744,238, issued on May 17, 1988, to Halbert for PNEUMATIC RIVET SETTING TOOL. This setting tool includes a rivet feed mechanism, a rivet magazine and sequencing controls providing cycle-through operation that utilizes pneumatic logic control.

A self-diagnosing blind rivet tool is disclosed in U.S. Pat. No. 4,754,643, issued on Jul. 5, 1988, to Weeks, Jr. et al. for METHOD AND APPARATUS FOR AUTOMATICALLY INSTALLING MANDREL RIVETS. This patent is directed to an automated and semi-automated rivet installation system that has the ability to diagnose selected tool conditions and to convey information on the conditions to the operator. Monitored conditions include the rivet placement within the tool, mechanism positions, and air pressure conditions.

One common shortcoming of prior art apparatus for the installation of blind rivets is the inability of the operator to gauge the correctness of the rivet set which, as the second head is created on the far side (or the blind side) of the elements being riveted, cannot be readily determined by observation or touch. In response to this need, it has been suggested that an electroacoustic transducer be used to convert the mechanical breaking of the mandrel at the conclusion of the setting process to an electric signal for determination of the correctness of the set. It has been further suggested that a strain gage be employed to sense the setting force of the rivet. These methods, however, provide the operator with limited set condition information. Consequently, the set condition of the rivet is assessable only in a marginal way.

Accordingly, there is still a need for a system by which a blind rivet may be first set and then the correctness of that set fully and reliably verified.

SUMMARY OF THE INVENTION

It is therefore an object of the present invention to overcome the disadvantages associated with known blind rivet setting tools by providing an improved rivet setting and correctness verification system.

It is a further object of the present invention to provide a system by which both the mandrel pulling force of the setting tool and the axial displacement of the pulling shaft may be measured then interpreted by an integrator to determine the total energy of the setting process.

Still another object of this invention is to provide such a system that compares the identified and actual total energy of a particular set against a known ideal total energy to assess whether or not the set of the particular rivet is correct.

Yet still another object of the present invention is to provide further verification of the set by comparing the actual displacement of the mandrel between selected points during the setting process against a predetermined ideal value.

Still a further object of the present system is to provide additional verification of the set by comparing a value representing the amount of force expended between two displacement positions against a stored ideal value.

A further object of the present invention is to provide a system for setting a rivet and then assessing the correctness of the set that is both convenient to operate and is easy to maintain.

The present invention achieves these and other objectives in an improved blind rivet setting system that comprises a blind rivet setting tool and a programmed system control circuit. The tool body includes a jaw assembly attached to an axially movable pulling shaft. Fluid pressure provided by a pressure source against a piston fixed to the movable pulling shaft acts on the shaft to cause aftward movement to set into motion a series of mechanical operations.

The aftward movement first causes a jaw case of the jaw assembly to grip the stem of a mandrel of a blind rivet at the beginning of a setting operation. Continuing aftward movement then brings the head of the mandrel into the open end of the tubular rivet body, causing it to initially deform. Still further aftward movement of the mandrel completes the deformation of the rivet body such that a secondary head is formed. The stem of the mandrel finally breaks from the head, and the rivet set is complete.

Sensors provided in association with the tool continuously monitor the status of the pulling shaft. Specifically, sensors measure the pulling force of the pulling shaft to produce a series of force values and the axial displacement of the shaft to produce a series of displacement values. These values are initially interpreted to produce a force versus displacement curve. An integrator sums the area under the force versus displacement curve by utilizing selected force versus displacement readings and integrates the curve to define an actual total energy value of the setting process. This actual total energy value is then compared against an ideal total energy value for the setting of a given rivet as determined by experimentation. A signal is provided to the operator to indicate favorable or unfavorable correspondence with the reference curve and to thus indicate the acceptability of the rivet set.

Other values based on force differences at given intervals and shaft displacement at given intervals may be compared against ideal values for further set verification.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENT

Figure 1:
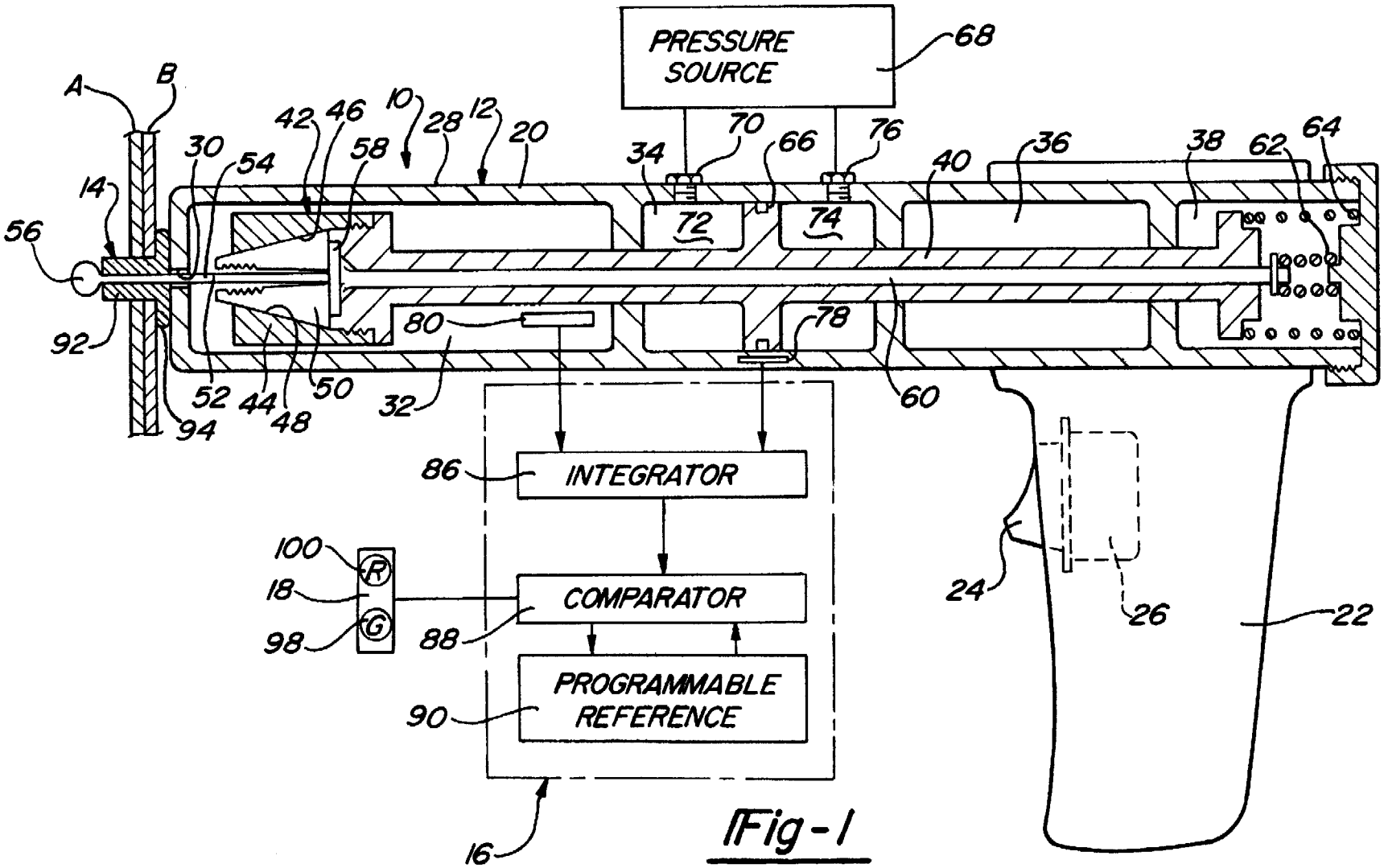
FIG. 1 is a combined pictorial and block diagram of the blind rivet setting system of the present invention showing the setting tool component in partial cross-section.

Reference is first made to FIG. 1 wherein the system for setting blind rivets and for verifying the correctness of their set according to the present invention is generally illustrated as 10. The system 10 includes a blind rivet setting tool 12 for setting a blind rivet 14, a system control circuit 16, and an indicator 18. The circuit 16 could be a microprocessor. The blind rivet 14 is shown as being in position to fasten two components A and B together.

The tool 12 comprises an elongated body generally illustrated as 20. While the body 20 may be of any of several constructions, it is preferably provided with a pistol grip-type handle 22 as shown. A trigger switch 24 which actuates the tool 12 is fitted preferably in the front face of the handle 22 in a conventional manner, and is operationally associated with a trigger valve 26.

The elongated body 20 includes an elongated housing 28. The housing 28 includes a mandrel-passing aperture 30 defined in its fore end. While not limited to this construction, the housing 28, as illustrated, is subdivided internally into a fore chamber 32 and a hydraulic cylinder chamber 34. An aft chamber 36 may be included and may be subdivided so as to incorporate a rear section 38. The elongated body 20 includes an axially movable pulling shaft 40 provided along its long axis. It must be understood that the construction of the housing 28 may be varied in many ways, with its only essential feature being that it provide support for the pulling shaft 40 and for a means of axially moving the shaft.

A jaw assembly 42 is operatively associated with the fore end of the pulling shaft 40. The jaw assembly 42 includes a jaw case 44 having an internal beveled wedging surface 46 that defines an internal bore 48. An array of split jaws 50 are movably provided within the case 44. When the outer surfaces of the split jaws 50 act against the beveled surface 46, the jaws 50 engage and grip an elongated stem 52 of a mandrel 54 of the blind rivet 14. The mandrel 54 also includes a head 56. The mandrel 54 comprises the head deforming component of the rivet 14 as will be explained below. A variety of methods may be employed to manipulate the jaw assembly 42 to grasp and hold the stem 52 of the mandrel 54. While one such method is discussed hereafter, the various methods of construction of rivet setting tools are well known to those skilled in the art, and it is accordingly to be understood that the following construction is only illustrative and is not intended to be limiting.

According to the illustrated construction of the present invention, a pusher 58 is fixed to the forward end of a pusher rod 60. The pusher rod 60 is provided within a central throughbore defined in the pulling shaft 40. The pusher rod 60 is axially movable within this throughbore and is biased at its aft end against the back wall of the rear section 38 of the aft chamber 36 by a spring 62. A weaker spring 64 acts between the same wall and the aft end of the pulling shaft 40.

A piston 66 is fixed to the pulling shaft 40 and is capable of axial motion in both fore and aft directions within the hydraulic cylinder chamber 34. A pressure source 68 forces a pressurized fluid (not shown) into the cylinder chamber 34 through a pressurized fluid port 70 into a pressurizable side 72 of the hydraulic cylinder chamber 34. By introducing a pressurized fluid into the fluid-tight chamber defined within the pressurizable side 72, the piston 66 is forced to move aftward.

It should be noted, however, that in lieu of using a pressurized fluid to cause aftward movement of the piston 66, a vacuum pump (not shown) may be employed in place of the pressure source 68 to create a vacuum within a vacuum side 74 of the hydraulic cylinder chamber 34 by drawing a fluid (again not shown) from the vacuum side 74 through a vacuum port 76.

Regardless of the method used to cause movement of the piston 66, the important feature of the piston-actuating maneuver lies in ultimate aftward axial movement of the pulling shaft 40.

A force transducer (load cell) 78 is provided in operative association with the axially movable pulling shaft 40. The force transducer 78, which is preferably of the strain gage type, produces an electrical output signal (F) the magnitude of which is proportional to the sensed pulling force exerted on the pulling shaft 40.

A linear encoder 80 (a digital-output displacement transducer or other suitable displacement measuring structure such as a linear variable differential transformer) is also provided in operative association with the pulling shaft 40. The encoder 80 produces an output signal (S) related to the linear displacement of the shaft 40. Specific placement of the transducer 78 and the encoder 80 as shown in FIG. 1 is only illustrative, and these components may be placed in other areas along the shaft 40 as may be understood by one skilled in the art.

The force (F) and displacement (S) signals are supplied to an integrator circuit 86 which monitors the sensed signals throughout the riveting cycle of the tool 12. The integrator circuit 86 is designed to determine the actual total energy used in the setting process. This is preferably accomplished by developing a force-versus-displacement curve from the monitored force (F) and displacement (S) signals and then determining the area under the curve which is proportional to the total actual energy of the setting process. The integrator circuit 86 is adapted to produce a corresponding output signal to a comparator circuit 88 which compares the actual total energy value of the particular rivet set as determined by the integrator circuit 86 with an experimentally-derived ideal total energy value stored in a programmable reference 90 for the setting of the particular type of rivet involved. If the actual observed energy of the set is within a predefined acceptable tolerance range of the prestored ideal value, a green light 98 on the indicator 18 is illuminated. If on the other hand the actual observed energy of the set is outside the prescribed tolerance range, a red light 100 is illuminated.

Figure 2:
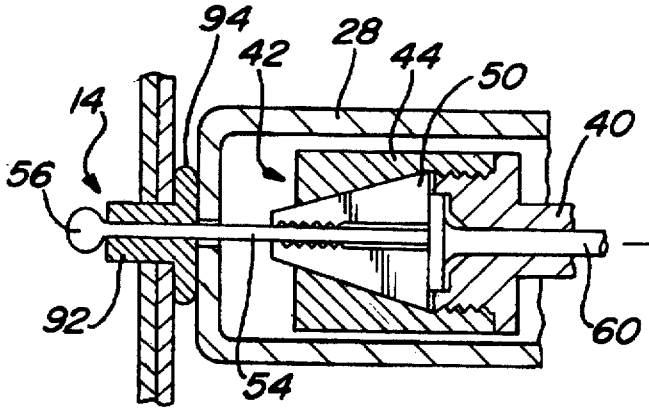
FIG. 2 is an enlarged view of the jaw assembly of the present invention in relation to a rivet, both shown in cross-section.
Figure 3:
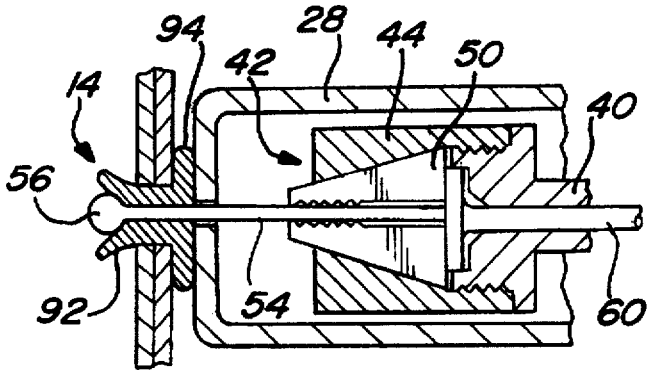
FIG. 3 is a view similar to that of FIG. 2 except showing relative horizontal aftward movement of the jaws.
Figure 4:
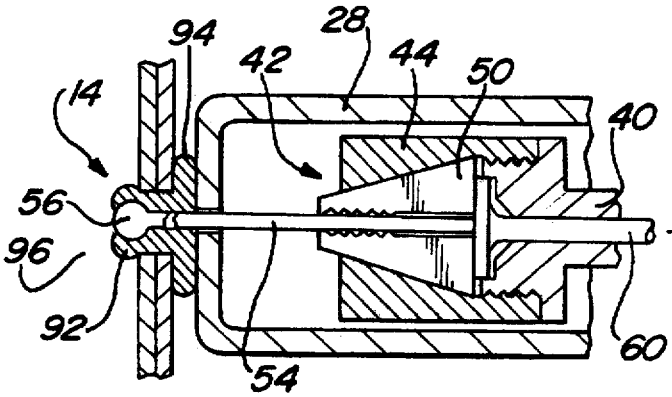
FIG. 4 is another view similar to that of FIG. 2 with even greater aftward movement of the jaws than shown in FIG. 3.

While FIG. 1 illustrates the mandrel 54 being only loosely held between the split jaws 50, FIGS. 2 through 4 illustrate the aftward progression of the pulling shaft 40 and its influence on the jaw assembly 42. With reference, then, to all of the FIGS. 1 through 4, as the pulling shaft 40 is forced aftward by fluid pressure (according to the preferred embodiment) against the resistance of the weaker spring 64, the pusher rod 60, biased against the stronger spring 62, resists aftward movement, causing the pusher 58 to act against the aft sides of the split jaws 50. The outer surfaces of the split jaws 50 act against the internal beveled wedging surface 46 to grip the stem 52, as illustrated in FIGS. 2 through 4. Once the stem 52 is gripped and the split jaws 50 are fully lodged between the surface 46 and the stem 52, the pusher rod 60 moves aftward with the pulling shaft 40, the biasing force of the stronger spring 62 now overcome.

FIG. 2 illustrates the relative positions of the mandrel 54 of the blind rivet 14 and the split jaws 50 of the jaw assembly 42 when the stem 52 is initially gripped. As may be seen, the blind rivet 14 includes a tubular rivet body 92 having a primary head 94 at the aft end of the body 92. In the illustrated initial cycle position, the head 56 remains adjacent the forward end of the body 92. This comprises the initial cycle position "I".

As the jaw assembly 42 is carried aftward by movement of the pulling shaft 40, the head 56 of the rivet 14 enters the tubular body 92 which begins to deform, as illustrated in FIG. 3. This comprises the secondary cycle position "S".

Continued aftward movement of the jaw assembly 42 by movement of the pulling shaft 40 pulls the head 56 into the tubular body 92 causing its maximum deformation as illustrated in FIG. 4. The mandrel 54 breaks off from the head 56, and a secondary head 96 is created by the combination of the now-unattached head 56 and the tubular body 92. This comprises the breaking position "B".

When fluid pressure within the side 72 is released (or when the vacuum in the side 74 is filled), both the pulling shaft 40 and the pusher rod 60 are restored to their preengaged positions by the biasing forces of the springs 62 and 64. With the force on the jaws 50 removed, the jaws 50 are relaxed to their preengaged positions and the stem 52 is released. The tool 12 is then ready to repeat its cycle.

Figure 5:
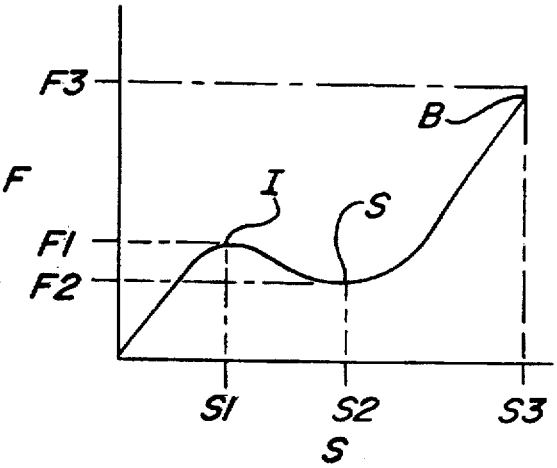
FIG. 5 shows a coordinate graph illustrating the force versus displacement curve for a blind rivet being set with displacement measured along the X-axis and force measured along the Y-axis.

FIG. 5 is a graph demonstrating how the pulling force (F) varies relative to shaft displacement (S) during a typical rivet set process. The illustrated axes are oriented by reference to a planar Cartesian coordinate system with displacement being measured along line X—X and force being measured along line Y—Y. Once the stem 52 is gripped by the split jaws 50, the pulling force F increases with displacement until the head 56 of the rivet 14 is adjacent the fore end of the tubular rivet body 92. This is the initial peak force F1 which occurs at the initial displacement position S1, designated point "I" on the graph, or the initial cycle position.

The force F gradually falls from the initial peak force F1 to a decreased force level F2 which occurs at the secondary displacement position S2, designated point "S" on the graph. From this point the force F gradually increases with displacement until the mandrel breaking force F3 is reached at the breaking displacement position S3, designated point "B". With the stem 52 broken from the head 56, the rivet setting process is complete.

As discussed above with respect to FIG. 1, the total energy required for the set is compared against an ideal total energy value to verify the acceptability of the set. In addition to this primary verification procedure, additional and/or alternative ways of verifying the acceptability of the set are possible by comparing selected actual force and displacement values at predetermined value points on the curve to desired values stored in the programmable reference 90 of the comparator circuit 88.

In particular, the additional set verification procedures may be divided into two groups. The first group comprises set verification procedures based on the comparison against a desired value of the difference between first and second observed force values at predetermined points in the setting process. This procedure is primarily designed to ensure that the actual curve is similar to the desired curve. The second group comprises set verification procedure based on the comparison against a desired value of the observed amount of displacement between specified points in the setting process.

With respect to the first group, three force value comparisons may preferably be made, although it is conceivable that other comparisons may be made. The first alternative procedure comprises a comparison of the value representing the difference between the observed initial peak force F1 and the mandrel breaking force F3 against a desired value. A second comparison may be made between the value representing the difference between the observed peak force F1 and the reduced force level F2 and a corresponding desired value. Finally, a third comparison may be made between the value representing the difference between the observed reduced force level F2 and the breaking force F3 and a corresponding desired value. In each of these instances, if the actual observed value is within a prescribed range of the desired corresponding value, the set is determined to be acceptable, and the operator is so notified.

With respect to the second group of set verification procedures, again three value comparisons may be made, although, as with the first group, other comparisons may be made at intervals other than those specified. A first comparison may be made between a desired value and the observed displacement between the initial and secondary displacement positions S1 and S2. A second comparison may be made between a desired value and the observed displacement between the initial and breaking displacement positions S1 and S3. Finally, a third comparison may be made between a desired value and the observed displacement between the secondary and breaking displacement positions S2 and S3. Again, in each of these instances, if the actual value is within a prescribed range of the desired value, the set is determined to be correct, and the operator is accordingly notified.

The above-described groups of additional set verification procedures are not compulsory, and any or all of them may be used to further verify the acceptability of the set.

To apprise the operator of the acceptability or non-acceptability of a particular rivet set, the indicator 18 produces a rivet set quality signal. While the signal may be of a variety of forms such as an audible tone, it is preferred that it be visual so as to overcome common noises of the workplace. Accordingly, in the preferred embodiment a green "correct" set light 98 and a red "incorrect" set light 100 are provided. If desired, a rivet setting data recorder (not shown) may be incorporated to provide the user with a permanent set quality record.

Figure 6:
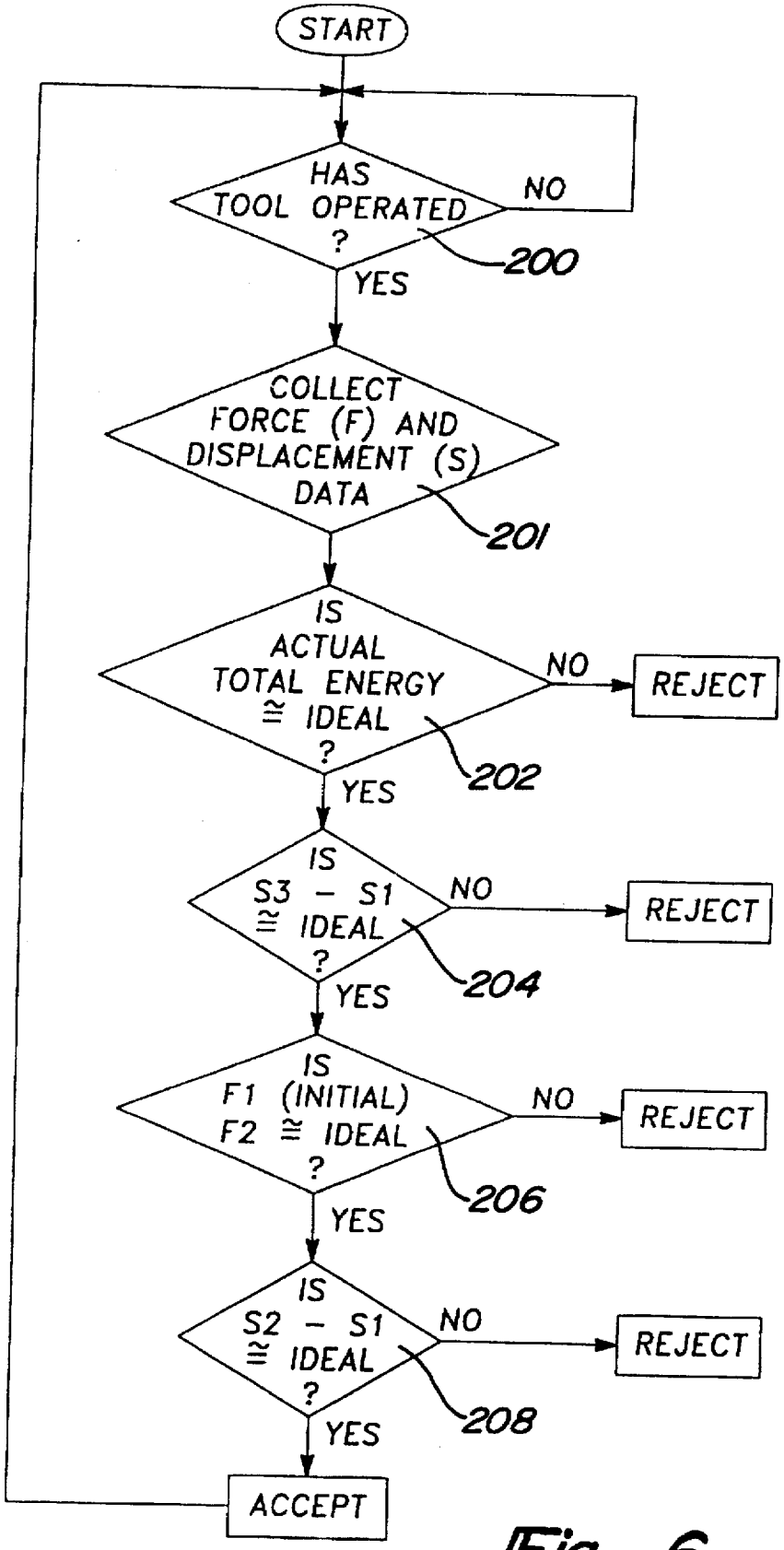
FIG. 6 is a control flowchart of illustrative set verification steps in accordance with this invention.

The system control circuit 16 includes a programmed control algorithm. The control algorithm used in the preferred embodiment will now be described by reference to a flow chart shown in FIG. 6, in which an exemplary overall operation flow of the present invention is set forth.

Operation of the tool 12 is initiated via actuation of the trigger 24. The control algorithm makes an initial query at Step 200 as to whether or not the tool has, in fact, been operated. When it is found that the tool has not been operated, the cycle is reset to the initial query until there is verification that the tool has been operated.

Once operation of the tool 12 is verified, the algorithm collects the force (F) and displacement (S) data at step 201 and determines the total energy used during the set process. The algorithm then moves to Step 202 to compare the actual total energy value against the ideal total energy value. If at Step 202 it is determined that the actual total energy value is not within a predetermined range of the ideal total energy, the set is rejected and the red light 100 is illuminated indicating to the operator that the set is unacceptable.

Conversely, if the set examined at Step 202 is found to be within the acceptable total energy range, the algorithm moves to exemplary Step 204 for additional correct set verification in which the amount of observed displacement between the initial displacement position S1 and the breaking position S3 is compared against a predetermined ideal value range. An unfavorable comparison would result in a rejection of the set and the red light 100 being illuminated.

However, if the set is found to be favorable, the algorithm moves to exemplary Step 206 in which the difference between the initial force value F1 and the decreased force value F2 is compared against a predetermined ideal difference range. Again, an unsatisfactory comparison would result in the "incorrect" set red light 100 being illuminated.

If the comparison of Step 206 is favorable, then the algorithm moves on to the further exemplary Step 208 in which the observed displacement between the initial displacement position S1 and the secondary displacement position S2 is compared against a predetermined ideal value range. If the comparison is unsatisfactory, the set is rejected, and the operator is so advised by the illumination of the red light 100. If the comparison is satisfactory, the operator is informed of this by illumination of the green "correct" set light 98 and the algorithm returns to Start to await the next cycle.

Of course, the order of the Steps 200–208 may be varied according to preference and a greater or lesser number of verification steps may be used. For example, it may be desired that only a single verification step (preferably, the initial total force value step) be used. Furthermore, the order and number of steps may be varied according to rivet type. Again for example, a first rivet type may involve only a single verification step, whereas a second rivet type may involve several.

Additionally, as will be appreciated by those skilled in the art, the system control circuit 16 may be implemented with discrete analog circuity, with a custom designed integrated circuit, or with a programmable microcomputer, depending upon the particular application, the cost constraints of the system, and the control flexibility desired.

While the above description comprises the preferred embodiment, it will be appreciated that the present invention is susceptible to modification and variation without departing the fair meaning or proper scope of the adjoining claims.

What is claimed is:

1. A system for setting a blind rivet and evaluating the acceptability of the set, said rivet being of the type having a frangible tubular body and an elongated mandrel that includes an enlarged head and a stem extending rearwardly of the head and through said frangible tubular body, said system comprising:

a blind rivet setting tool, said tool including a body, said body having a long axis, said tool having a mandrel engaging mechanism for engaging said stem of said mandrel, said engaging mechanism being reciprocable in the axial direction along said long axis of said body, said tool further including force applying means for acting on said engaging mechanism to forcibly move said mechanism in said axial direction to cause the head of the mandrel to deform the tubular body and create a secondary head and to thereafter break the stem of the mandrel from the head and complete the rivet setting process;

a first transducer operatively associated with said tool for measuring the force applied by said force applying means to move said engaging mechanism and producing a force output signal related thereto;

a second transducer operatively associated with said tool for measuring the movement of said engaging mechanism in said axial direction and producing a displacement output signal related thereto; and a control circuit for receiving said force output signal and said displacement output signal and determining therefrom the total energy used during the rivet setting process and comparing said determined total energy with a predetermined desired value.

2. The system of claim 1 further including an indicator operatively attached to said control circuit for signalling to an operator the correctness of the set based on said total energy against said predetermined desired value comparison.

3. The system of claim 1 wherein said first transducer is a strain gage.

4. The system of claim 1 wherein said second transducer is a linear variable differential transformer.

5. The system of claim 1 wherein said control circuit includes circuitry to:

develop from said force and displacement output signals a force-versus-displacement curve; and determine the total energy by determining the area under the curve.

6. A system for setting a blind rivet and evaluating the acceptability of the set, said rivet being of the type having a frangible tubular body and an elongated mandrel that includes an enlarged head and a stem extending rearwardly of the head and through said frangible tubular body, said system comprising:

a blind rivet setting tool, said tool including a body, said body having a long axis, said tool having a mandrel engaging mechanism for engaging said stem of said mandrel, said engaging mechanism being reciprocable in the axial direction along said long axis of said body, said tool further including force applying means for acting on said engaging mechanism to forcibly move said mechanism in said axial direction to cause the head of the mandrel to deform the tubular body and create a secondary head and to thereafter break the stem of the mandrel from the head and complete the rivet setting process;

a transducer operatively associated with said tool for measuring the force applied by said force applying means to move said engaging mechanism during the rivet setting process and producing a series of force output signals related thereto including a first force output signal at a first interval of the rivet setting process and a second force output signal at a second interval of said setting process; and a control circuit for receiving said first and second force output signals and determining the difference therebetween and comparing said determined difference with a predetermined desired value.

7. The system of claim 6 further including an indicator operatively attached to said control circuit for signalling to an operator the correctness of the set based on said comparison of the difference between said first and second force signals and the predetermined desired value.

8. The system of claim 6 wherein said transducer is a strain gage.

9. The system of claim 6 wherein said control circuit includes an integrator, a comparator connected to said integrator, and a programmable reference connected to said comparator.

10. A system for setting a blind rivet and evaluating the acceptability of the set, said rivet being of the type having a frangible tubular body and an elongated mandrel that includes an enlarged head and a stem extending rearwardly of the head and through said frangible tubular body, said system comprising:

a blind rivet setting tool, said tool including a body, said body having a long axis, said tool having a mandrel engaging mechanism for engaging said stem of said mandrel, said engaging mechanism being reciprocable in the axial direction along said long axis of said body, said tool further including a piston assembly operatively connected to said engaging mechanism to forcibly move said mechanism in said axial direction to cause the head of the mandrel to deform the tubular body and create a secondary head and to thereafter break the stem of the mandrel from the head and complete the rivet setting process;

a transducer for measuring the movement of said engaging mechanism in said axial direction and producing a first displacement output signal related to the position of said engaging mechanism at a first interval of the setting process and a second displacement output signal related to the position of said engaging mechanism at a second interval of the setting process; and a control circuit for receiving said first and second displacement output signals and determining the difference therebetween and comparing the determined difference with a predetermined desired value.

11. The system of claim 10 further including an indicator operatively attached to said control circuit for signalling to an operator the correctness of the set based on said comparison of the difference between said first and second displacement output signals and said predetermined desired value.

12. The system of claim 10 wherein said transducer is a linear variable differential transformer.

13. The system of claim 10 wherein said control circuit includes an integrator, a comparator connected to said integrator, and a programmable reference connected to said comparator.

14. A method for setting a blind rivet having a mandrel defining an axis and for evaluating the acceptability of the set, said method including the steps of:

engaging the mandrel with an axially moveable mandrel engaging mechanism;

setting the blind rivet in a desired position by forcibly displacing the mandrel engaging mechanism in the axial direction;

measuring the force applied to said mandrel engaging mechanism during the setting process;

measuring the axial displacement of said mandrel engaging mechanism during said setting process;

determining the total energy used during said rivet setting process from said force and displacement measurements; and comparing the determined total energy with a predetermined desired value.

15. The method of claim 14 wherein said step of determining the total energy used during the rivet setting process includes the step of developing a force-versus-displacement curve from said force and displacement measurements.

16. The method of claim 15 wherein said step of developing a force-versus-displacement curve includes the step of determining the area under the curve which is proportional to the total energy used during the setting process.

17. A method for setting a blind rivet having a mandrel and for evaluating the acceptability of the set, said method including the steps of:

setting a blind rivet in a desired position with a blind rivet setting tool, said tool having a mandrel engaging mechanism for forcibly driving the mandrel;

measuring the force of said mandrel engaging mechanism applied to said mandrel of said blind rivet at a first interval of the setting process;

measuring the force of said mandrel engaging mechanism applied to said mandrel of said blind rivet at a second interval of said setting process;

determining the difference between said force applied at said first interval and said force applied at said second interval; and comparing said determined force difference with a predetermined desired value.

18. The method of claim 17 wherein said blind rivet includes a head, an attached stem, and a tubular rivet body and wherein said first interval represents an observed initial peak force where said head of the blind rivet is adjacent said end of said tubular rivet body and said second interval represents an mandrel breaking force where said stem of the blind rivet breaks from said head.

19. The method of claim 17 wherein said blind rivet includes a head, an attached stem, and a tubular rivet body and wherein said first interval represents an observed initial peak force where said head of the blind rivet is adjacent the end of said tubular rivet body and said second interval represents a reduced force level where the force level falls to its lowest point between said initial peak force and a mandrel breaking force where said stem of the blind rivet breaks from said head.

20. The method of claim 17 wherein said blind rivet includes a head, an attached stem, and a tubular rivet body and wherein said first interval represents a reduced force level where the force level falls to its lowest point between an initial peak force where said head of said blind rivet is adjacent said end of said tubular rivet body and a mandrel breaking force where said stem of the blind rivet breaks from said head and said second interval represents said mandrel breaking force.

21. A method for setting a blind rivet having a mandrel and for evaluating the acceptability of the set, said method including the steps of:

setting a blind rivet in a desired position with a blind rivet setting tool, said tool having an axially movable mandrel engaging mechanism for forcibly driving the mandrel in the axial direction;

measuring the axial movement of said mandrel engaging mechanism between a first interval of said setting process and a second interval of said process; and comparing the measured movement with a predetermined desired value.

22. The method of claim 21 wherein said blind rivet includes a head, an attached stem, and a tubular rivet body and wherein said first interval represents an observed initial position of said engaging mechanism where said head of said blind rivet is adjacent said end of said tubular rivet body and said second interval represents a mandrel breaking position of said engaging mechanism where said stem of said blind rivet breaks from said head.

23. The method of claim 21 wherein said blind rivet includes a head, an attached stem, and a tubular rivet body and wherein said first interval represents an observed initial peak position of said engaging mechanism where said head of said blind rivet is adjacent said end of said tubular rivet body and said second interval represents a secondary displacement position of said engaging mechanism where the force of said engaging mechanism acting on said stem is at its lowest point between said initial peak position and a mandrel breaking position where said stem of said blind rivet breaks from said head.

24. The method of claim 21 wherein said blind rivet includes a head, an attached stem, and a tubular rivet body and wherein said first interval represents a displacement position of said engaging mechanism where the force of said engaging mechanism acting on said stem is at its lowest point between the initial peak position where said head of said blind rivet is adjacent said end of said tubular rivet body and a mandrel breaking position where said stem of said blind rivet breaks from said head and said second interval represents said mandrel breaking position of said engaging mechanism.

* * * * *